United States Patent [19]

Inoue et al.

[11] 3,998,458

[45] Dec. 21, 1976

[54] GOLF CLUB SHAFT

[75] Inventors: Mitsuhiro Inoue, Shimodate; Yo Maeda, Yuki; Kohei Tsumura; Syozo Ohashi, both of Shimodate, all of Japan

[73] Assignee: Hitachi Chemical Co., Ltd., Tokyo, Japan

[22] Filed: July 10, 1975

[21] Appl. No.: 594,889

[30] Foreign Application Priority Data

July 12, 1974 Japan ..... 49-79192

[52] U.S. Cl. ..... 273/80 R; 273/DIG. 23

[51] Int. Cl.[2] ..... A63B 53/10

[58] Field of Search ..... 273/67 R, 67 A, 73 F, 273/80 R, 80 B, 80.9, DIG. 7, DIG. 23, 82 R; 43/18 GF; 280/11.13 L, 11.37 B, 11.37 L; 138/144, 123, 124, 125, 129, 130; 156/148, 161, 185, 188; 428/246, 268, 401

[56] References Cited

UNITED STATES PATENTS

| | | | |
|---|---|---|---|
| 2,008,077 | 7/1935 | Livesay | 273/80.9 |
| 2,008,423 | 7/1935 | Ritchie | 273/80.9 |
| 2,100,307 | 11/1937 | Mc Minn | 273/80 B X |
| 2,742,931 | 4/1956 | De Ganahl | 273/DIG. 7 |
| 2,934,345 | 4/1960 | Scott | 273/80 B |
| 3,083,969 | 4/1963 | Bills | 273/80 B |
| 3,313,541 | 4/1967 | Benkoczy et al. | 273/80 R |
| 3,367,656 | 2/1968 | Medney | 273/82 R |
| 3,393,918 | 7/1968 | Styka | 273/DIG. 7 |
| 3,457,962 | 7/1969 | Shobert | 273/80 R X |
| 3,489,412 | 1/1970 | Franck et al. | 273/DIG. 7 |
| 3,880,422 | 4/1975 | Boggild | 273/DIG. 7 |
| 3,889,951 | 6/1975 | Schaefer et al. | 273/73 F |
| 3,896,858 | 7/1975 | Whatley | 273/DIG. 7 |

FOREIGN PATENTS OR APPLICATIONS

| | | | |
|---|---|---|---|
| 555,027 | 7/1943 | United Kingdom | 273/80 R |
| 1,261,541 | 1/1972 | United Kingdom | 273/DIG. 23 |

OTHER PUBLICATIONS

"Handbook of Reinforced Plastics" by Oleesky and Mohr; 1964; pp. 292–299, 407–409; Library of Congress Catalog, Card No. 64–15205.

*Primary Examiner*—Richard J. Apley
*Attorney, Agent, or Firm*—Burgess, Dinklage & Sprung

[57] ABSTRACT

A golf club shaft made of a filament reinforced resin wherein a group of filaments are wound at a winding angle of 10° or less and another group of filaments are wound at a winding angle of 25° to 65° and capable of much reducing the torsion of the shaft, reducing the weight of the shaft, increasing the bending strength of the shaft and increasing the flying distance of a golf ball.

4 Claims, 14 Drawing Figures

GOLF CLUB SHAFT

This invention relates to a golf club shaft made of fiber or filament reinforced plastics and more particularly to a golf club shaft of the kind improved in dynamic characteristics by specific orientation of the fiber or filament and formation of the shaft, which is capable of increasing the flying distance of a golf ball due to its small torsion and light weight, free from possible breakage due to its great resistance against rupture in bending and capable of providing a good feeling in swinging the club.

For materials of a golf club shaft, there have been conventionally employed hickory, steel, aluminum, etc. But recently, new materials have been developed one after another for the golf club shaft and new methods for producing the same have also been proposed in response to such newly developed materials.

The object of developing new materials and new methods for producing the golf club shaft is to increase the flying distance of a golf ball rather than to provide novelty or originality in appearance of the shaft of in handling.

Such an improvement in the flying distance of the golf ball depends upon a design of a golf club according to so-called human engineering, an improvement in materials of a golf club head or a quality of a golf ball. As to the golf club shaft, it is desirable to be as light as possible, having a given stiffness in bending. In other words, materials of high specific modulus are preferable for the golf club shaft.

There are many materials having a specific modulus higher than that of steel which has been most widely used heretofore for the golf club shaft. Table 1 summarizes materials employed for the golf club shaft in respect with their specific moduli. As can be seen in Table 1, materials composed of fibers or filaments and resinous materials, such as boron fiber reinforced plastics, carbon filament reinforced plastics or high-modulus organic fiber reinforced plastics show a high specific modulus. It is therefore understood why a shaft made or carbon filament reinforced plastics, so-called black shaft, has been attracting public attention as being capable of improving the flying distance of the golf ball. Likewise, it is understood that the boron reinforced plastics and the high-modulus organic fiber reinforced plastics have begun to be employed for the golf club shaft.

Table 1

| materials | Specific modulus of materials for golf club shaft: modulus E Kg/mm² | specific gravity γ | specific modulus E/γ Kg/mm² |
|---|---|---|---|
| steel | 21000 | 7.9 | 2660 |
| aluminum | 7400 | 2.8 | 2640 |
| wood (hickory) | 1100 | 0.6 | 1833 |
| titanium | 10000 | 4.5 | 2220 |
| glass fiber unidirectitionally reinforced epoxy resin Vf = 70% | 6130 | 2.1 | 2920 |
| high-modulus organic fiber (Du Pont KEVLAR 49) unidirectionally reinforced epoxy resin Vf = 70% | 7000 | 1.4 | 5000 |
| carbon filament (TORAY TORAYCA T200A) unidirectionally reinforced epoxy resin Vf = 70% | 14000 | 1.6 | 8750 |
| boron fiber unidirectionally reinforced epoxy resin Vf = 70% | 29400 | 2.17 | 13540 |

On the other hand, there has been developed a so-called hybrid shaft of steel and carbon filament reinforced plastics. This type of shaft shows excellent characteristics in torsional rigidity but is not desirable with respect to the specific modulus and accordingly it is not helpful to improve the flying distance of the golf ball. For this reason, such a hybrid shaft is recommendable. In order to improve the torsional rigidity, it is more advantageous to employ filament or fiber reinforced plastics and design the orientation of the filaments or fibers thereof so as to increase the torsional rigidity.

As mentioned above, all the materials having a high specific modulus as shown in Table 1 are filaments or fiber reinforced plastics. The filament of fiber reinforced plastics are liable to greatly change their dynamic characteristics by orientation of the filaments or fibers.

The typical methods for producing such filament or fiber reinforced plastics composed of filaments or fibers and resinous materials, and producing a golf club shaft employing the same are (1) a prepreg sheet winding method and (2) a filament winding method. In the prepreg sheet winding method, filaments or fibers are arranged in a sheet and impregnated with the resinous materials to form prepreg sheet, and the thus prepared prepreg sheet is cut into a trapezoid and wound around a mandrel of a truncated cone. Such a prepreg sheet winding method has advantages that the production time is much curtailed and that the production process is extremely simple but it has some drawbacks that variability in the resin content is not avoidable, that it is difficult to control the orientation of the filaments or fibers and that the filament or fiber content is rather poor as compared with that by the filament winding method. Whereas, according to the filament winding method, variability in the resin content and the orientation of the filaments is negligible and the filament or fiber content is the largest of the method for producing filament or fiber reinforced plastics. It is to be noted that the higher the filament or fiber content, the higher the specific modulus is.

A golf club shaft made of carbon filaments, boron-fibers or high-modulus organic fibers and resinous materials by the filament winding method is imparted with a specific modulus higher than that of a steel shaft or an aluminum shaft and accordingly made lighter keeping the same rigidity, so that the weight of the head can be made heavier with the same total weight of the shaft and the head speed is increased. Thus, the flying distance of the golf ball is enabled to be much increased. Fiber or filament reinforced plastics, however, have a disadvantage in that they are liable to be subjected to a torsion because of their low shearing modulus. The golf club shaft produced by the filament winding method and having desired bending characteristics is rather unstable with respect to the direction of the face of the golf club head because of its large torsion, making the flying course of the golf ball unstable. In order to reduce the torsion, the golf club shaft should be made thicker or the thickness of the shaft should be increased. The golf club shaft made thicker, however, is not desirable in view of the handle and the golf club shaft increased in thickness makes the total weight of the shaft heavier. Filament or fiber reinforced plastics will break not in a plastic region like steel or aluminum but in an elastic region and are relatively easy to break because of its small energy absorption.

The object of the present invention is then to provide a golf club shaft which is free from the above-mentioned defects and drawbacks of the shaft made by the conventional filament winding method.

According to the present invention, there is provided a hollow golf club shaft with its diameter reducing from one end to the other end, which consists essentially of a plurality of first groups of elongated filaments wound spirally about a longitudinal axis at a winding angle of 10° or less with said axis; a plurality of second groups of elongated filaments wound spirally about the axis at a winding angle of 10° or less with said axis in a direction opposite to said first groups; the amount of the filaments contained in said plurality of second groups being substantially equal in weight and volume to that of the first groups; a plurality of third groups of elongated filaments wound spirally about the axis at a winding angle of 25° to 65° with said axis; a plurality of fourth groups of elongated filaments wound spirally about the axis at a winding angle of 25° to 65° with said axis in a direction opposite to said third groups; the amount of the filaments contained in said plurality of fourth groups being substantially equal in weight and volume to that of the third groups; the first, second, third and fourth groups of filaments being laid upon one another in radial directions; the width of each of the groups of the filaments being less than the pitch of the respective spiral winding; and a heat-hardened synthetic resinous material binding the filaments and filling the interstices between the filaments to form a unitary solid mass of the shaft.

The invention will be better understood from the following description taken in connection with the accompanying drawings in which.

Figure 13:
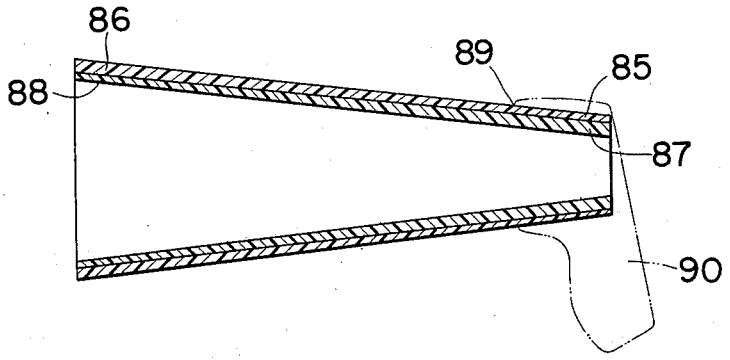
Figure 14:
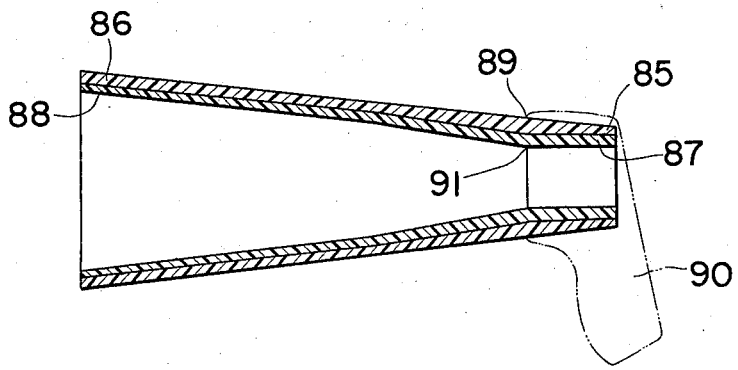

FIG. 10*a* is a longitudinal sectional view of the golf club shaft according to the filament winding of the present invention;

FIG. 10*b* is a cross sectional view of the shaft of FIG. 10*a*;

FIG. 11*a* is a side elevational view of the inner layer of the shaft of FIG. 10*a*;

FIG. 11*b* is a cross sectional view of the layer of FIG. 11*a*;

FIG. 12*a* is a side elevational view of the outer layer of the shaft of FIG. 10*a*;

FIG. 12*b* is a cross sectional view of the layer of FIG. 12*a*;

FIG. 13 is a longitudinal cross sectional view of one form of the golf club shaft according to the present invention in relation with a golf club head; and FIG. 14 is a longitudinal cross sectional view of another form of the golf club shaft according to the present invention in relation with a golf club head.

The relation between a winding angle of the filaments and dynamic characteristics and stresses applied to the golf club shaft are analyzed in the following.

The elastic rule of a filament wound material with an intersecting angle of $2\theta°$ is expressed by:

$$\begin{bmatrix} \gamma z \\ \gamma\theta \\ \tau_{\theta z} \end{bmatrix} = \begin{bmatrix} C_{11} C_{12} O \\ C_{12} C_{22} O \\ O O C_{33} \end{bmatrix} \begin{bmatrix} \epsilon z \\ \epsilon\theta \\ \delta_{\theta z} \end{bmatrix} \quad (1)$$

where $\gamma_z$ is an axial stress, $\gamma\theta$ is a circumferential stress, $\tau_{\theta z}$ is a shearing stress, C is a modulus, $\epsilon_z$ is an axial distortion, $\epsilon\theta$ is a circumferential distortion, and $\gamma$ is a shearing distortion.

The modulus C is:

$$\left.\begin{aligned} C_{11} &= 3K_1 + K_2 + K_2\cos 2\theta° + K_4\cos 4\theta° \\ C_{22} &= 3K_1 + K_2 - K_3\cos 2\theta° + K_4\cos 4\theta° \\ C_{33} &= K_1 + K_2 - K_4\cos 4\theta° \\ C_{12} &= K_1 - K_2 - K_4\cos 4\theta° \end{aligned}\right\} \quad (2)$$

where $$\left.\begin{aligned} K_1 &= \frac{1}{8\lambda}(E_L + E_T + 2E_L\nu_{TL}) \\ \lambda &= 1 - \nu_{LT}\nu_{TL} \\ K_2 &= \frac{1}{2\lambda}(\lambda G_{LT} - E_L\nu_{TL}) \\ K_3 &= \frac{1}{2\lambda}(E_L - E_T) \\ K_4 &= \frac{1}{8\lambda}(E_L + E_T - 2E_L\nu_{TL} - 4\lambda G_{LT}) \end{aligned}\right\} \quad (3)$$

and $E_L$ and a modulus in a direction of the orientation of fibers of unidirectional reinforcement, $E_T$ is a modulus in a direction normal with the orientation of fibers of unidirectional reinforcement, $\nu_{TL}$ is a Poisson's ratio in a direction of the orientation of fibers, $\nu_{LT}$ is a Poisson's ratio in a direction normal with the orientation of fibers, and $G_{LT}$ is a modulus of transverse elasticity.

Accordingly, a modulus of the axial elasticity $E_z$ and a modulus of the transverse elasticity $G_{\theta z}$ of the filament wound material are expressed by:

$$\left.\begin{aligned} E_z &= CN/(C_{22}C_{33} - C_{23}^2) \\ G_{\theta z} &= CN/(C_{11}C_{22} - C_{12}^2) \end{aligned}\right\} \quad (4)$$

where $$CN = C_{11}C_{22}C_{33} + 2C_{12}C_{13}C_{23} - (C_{11}C_{23}^2 + C_{22}C_{13}^2 + C_{33}C_{12}^2).$$

The modulus of the filament wound material with winding angles of $\theta_1°$, $\theta_2°$ . . . . $\theta_i°$ is obtained by inserting the following formulae $$\left.\begin{aligned} C_{11} &= \sum_{n=1}^{i} \frac{t_n}{t} C_{11}^{(n)} \\ C_{22} &= \sum_{n=1}^{i} \frac{t_n}{t} C_{22}^{(n)} \\ C_{33} &= \sum_{n=1}^{i} \frac{t_n}{t} C_{33}^{(n)} \\ C_{12} &= \sum_{n=1}^{i} \frac{t_n}{t} C_{12}^{(n)} \end{aligned}\right\} \quad (5)$$

into the formulae (4). $(n)$=(1), (2) . . . $(i)$ is a number of component constituting matrix of the filament wound material; $t_1$, $t_2$ . . . . $t_i$ designate respective thickness thereof; and t designates the total thickness of the filament wound material.

Figure 1:
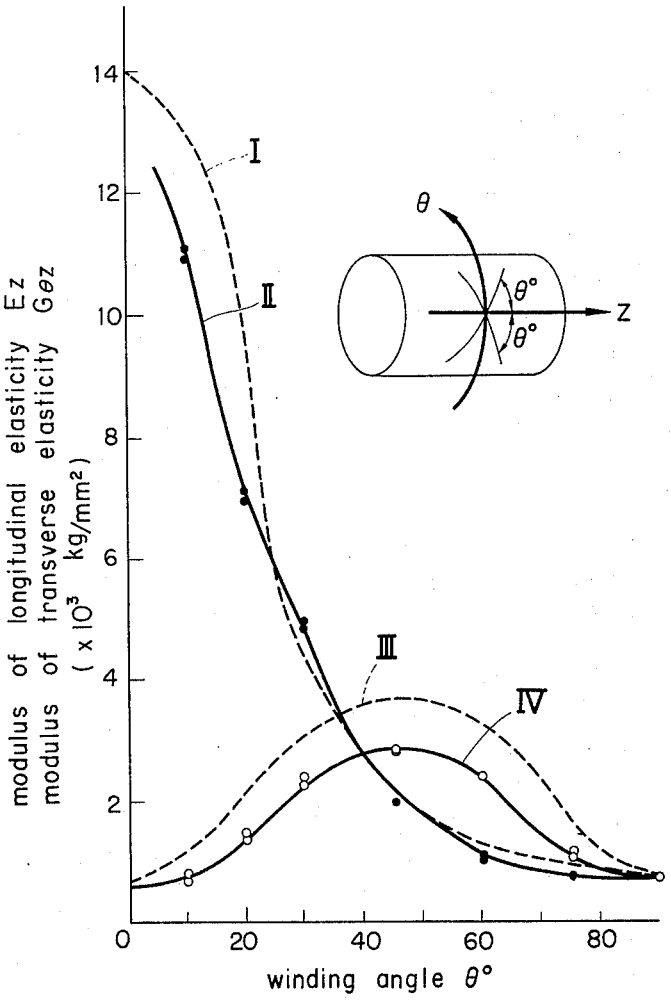
FIG. 1 shows the relation between a winding angle $\theta°$ of a carbon filament wound laminate and a modulus of longitudinal elasticity $E_z$ and a modulus of transverse elasticity $G_{\theta z}$.

In FIG. 1 showing the relation between the winding angle $\theta°$ of the carbon filament would laminate and the modulus of the longitudinal elasticity $E_z$ and the modulus of the transverse elasticity $G_{\theta z}$, broken lines I and III are theoretical curves of the modulus of the longitudinal elasticity $E_z$ and the modulus of the transverse elasticity $G_{\theta z}$, respectively, according to the formulae (1) to (4) wherein $E_L$ is determined to be 14000 Kg/mm², $E_T$ to be 800 Kg/mm², $\nu_{LT}$ to be 0.3 and $G_{LT}$ to be 700 Kg/mm².

Whereas, in FIG. 1, solid lines II and IV are measured curves of the modulus of the longitudinal elasticity $E_z$ and the modulus of the transverse elasticity $G_{\theta z}$, respectively. The measuring sample is summarized in Table 2. In the measurement, the modulus $E_z$ is obtained by forced vibration of a free-free bar and the modulus $G_{\theta z}$ is obtained based upon a period of a torsion pendulum.

Table 2

| | Carbon filament laminates used as a measuring sample |
|---|---|
| carbon filament | TORAY TORAYCA T200A |
| resin | epoxy resin of bisphenol type |
| hardening condition | 120° C × 2h, 150° C × 3h under pressure |
| filament content | Vf = 70% |
| shape | outer diameter: 12ϕ, inner diameter: 10ϕ, length: 350mm, cylindrical, ground surface |

As to the modulus of the filament wound material, the experimental values thereof generally agree with the calculated values according to the anisotropy theory as can be seen in FIG. 1. Accordingly, in designing of the filament wound material, the calculated curves of FIG. 1 may be employed.

In case the modulus $E_z$ and the modulus $G_{\theta z}$ are required to be as large as possible, the following should be taken into consideration.

The modulus $E_z$ is largest at the winding angle of 0° where the modulus $G_{\theta z}$ is at its minimum value. At the winding angle of 45° where the modulus $G_{\theta z}$ assumes its maximum value, the modulus $E_z$ is highly reduced. Thus, there is no winding angle which coincidently provides satisfactorily large moduli $E_z$ and $G_{\theta z}$. In this connection, it is necessitated to find out some meeting point. When the curve of the modulus $E_z$ is expressed by $E_z(\theta°)$ and the modulus $G_{\theta z}$ is expressed by $G_{\theta z}(\theta°)$ and a winding angle which constitutes the meeting point is assumed to be $\theta_A°$, the moduli $E_z$ and $G_{\theta z}$ at the winding angle of $\theta_A°$ are expressed by the moduli $E_z(\theta_A°)$ and $G_{\theta z}(\theta_A°)$.

As apparent from FIG. 1 and the formulae (1) to (4), $E_z(\theta°)$ and $G_{\theta z}(\theta°)$ are not linear nor parallel to each other. Accordingly, in order to provide a filament wound material with a winding angle of $\theta_A°$ having a modulus of longitudinal elasticity of $E_z(\theta_A°)$ and a modulus of transverse elasticity of more or less than $G_{\theta z}(\theta_A°)$, there is proposed a laminate with different winding angles.

Stated illustratively, if the laminate is designed so as to have a relation $$\sum_{n=1}^{i} \frac{t_n}{t} E_z(\theta_n°) = E_z(\theta_A°) \quad (6),$$

there will be realized a relation $$\sum_{n=1}^{i} \frac{t_n}{t} G_{\theta z}(\theta_n°) \gtreqless G_{\theta z}(\theta_A°) \quad (7)$$

where $\theta_1°$, $\theta_2°$ . . . $\theta_i°$ designate respective differing winding angles, $t_1$, $t_2$ . . . . $t_i$ respective thicknesses of layers of the laminate and t a total thickness of the laminate.

In other words, it can be solved by the laminate with different winding angles how to obtain the moduli $E_z$ and $G_{\theta z}$ as large as possible.

In designing the filament wound material, a strength as well as the moduli should be considered.

There are many theoretical formulae expressing the relation between the strength of a filament wound material and winding angles, which unfortunately generally do not coincide with measurement. The strength of the filament wound material varies with not only strength of fiber or resin employed therefor but also binding strength therebetween, micro-cracking or residual stress of respective materials, and accordingly the strength of the filament wound material generally changes depending upon its materials.

Figure 2:
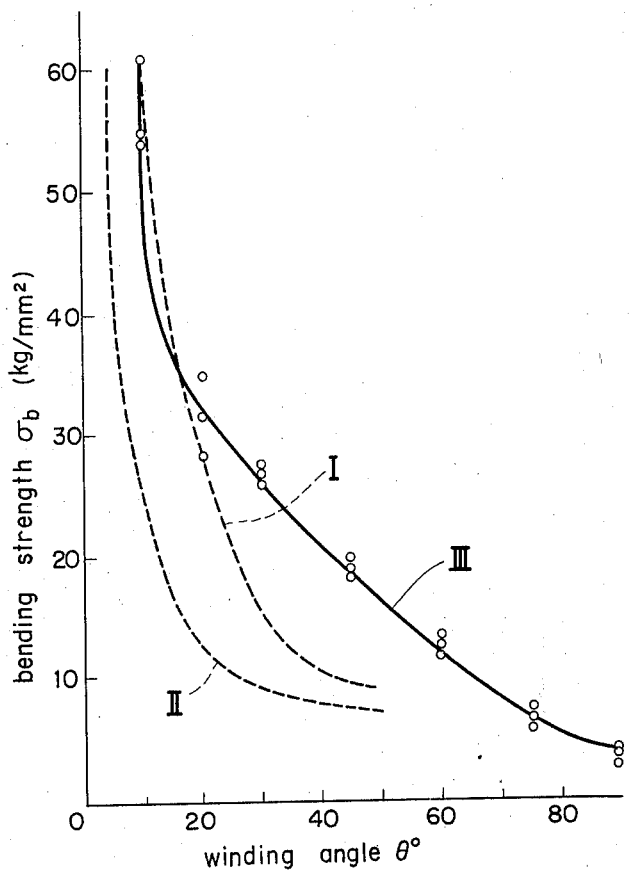
FIG. 2 shows the relation between a winding angle $\theta°$ of a carbon filament wound laminate and a resistance in bending $\gamma b$.

In FIG. 2, solid line III shows the relation between a winding angle $\theta°$ of the carbon filament wound material and a bending strength (according to three-point bending test with spans of 300mm), broken line I an expanded Mises Law[1], and broken line II a formula of Unemura[2].

1. Takeshi Hayashi, "Composite Material Engineering", Nikka Giren
2. Yamawaki and Uemura, "As to Basic Strength of Filament Wound Material" in 'Material vol. 19, No. 206', p. 968, 1970.

As mentioned above, the filament wound material should be designed taking the moduli as shown in FIG. 1 and the strength as shown in FIG. 2 into consideration. As in case of the moduli, the curve of the bending strength $\sigma_\theta$ is expressed by $\sigma_b(\theta°)$. As to the strength, the laminate with different angles is also advantageous to obtain a strength $\sigma_\theta$ larger than $\sigma_\theta$ $(\theta_A°)$ keeping a modulus $E_z(\theta_A°)$ and a modulus $G_{\theta z}$ larger than $G_{\theta z}(\theta_A°)$.

Stated illustratively, if the laminate is designed so as to satisfy the following relation $$\sum_{n=1}^{i} \frac{tn}{t} E_z(\theta_n°) = E_z(\theta_A°) \quad (6),$$

the following relations $$\sum_{n=1}^{i} \frac{tn}{t} G_{\theta z}(\theta_n°) \geqq G_\theta(\theta_A°) \quad (7)$$

$$\sum_{n=1}^{i} \frac{tn}{t} \sigma_b(\theta_n°) \geqq \delta_b(\theta_A°) \quad (8)$$

are obtained.

Except for a special case, it is desirable that the values of $E_z$, $G_{\theta z}$ and $\sigma_b$ and as large as possible. To meet this requirement, the laminate with different winding angles is recommended.

Figure 3:
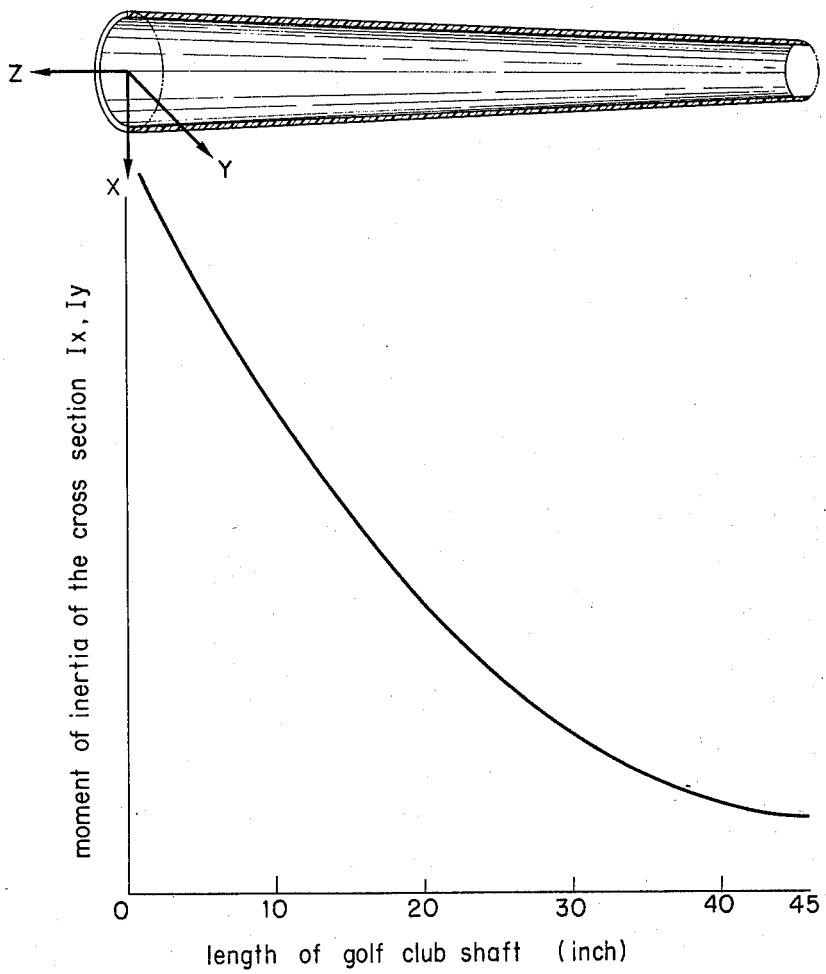
FIG. 3 shows the relation between a length of the golf club shaft and moment of inertia of the cross section Ix or Iy.

In the following, stresses to be applied to the golf club shaft are analyzed. FIG. 3 shows the relation between a configuration of the golf club shaft and a moment of inertia of the cross section Ix and the relation between a length of the shaft and a moment of inertia of the cross section Iy. If the golf club shaft is assumed to be a cantilever beam, the torsion the golf club shaft undergoes is expressed by the following formula $$\bar{\theta} = \frac{T}{G_{\theta z}} \int_O^l \frac{l}{IP} dx \quad (9)$$

where $\bar{\theta}$ is a torsional angle,

T is a torsional torque, $G_{\theta z}$ is a modulus of transverse elasticity, l is a whole length of the shaft, IP is a porlar moment of inertia of the cross section (corresponding to 2Ix or 2Iy).

From the formula (9) and the relation between the moment of inertia of the cross section and the length of the shaft as shown in FIG. 3, the torsion of the shaft is much larger at the portion of a reduced diameter than at the portion of an increased diameter, On the other hand, there is the following relation as to a bending $$\frac{1}{\rho} = \frac{M}{Ez \cdot Ix(Iy)} \quad (10)$$

where $\rho$ is a curvature radius,

M is a bending moment (O at the tip end portion of the shaft and maximum at the opposite end portion), and $E_z$ is a modulus of transverse elasticity.

Since both of the bending moment and the moment of inertia of the cross section are large at said opposite end portion where a grip is attached and both of the bending moment and the moment of inertia of the cross section are small at the tip end portion on which the golf club head is mounted, the curvature radius $\rho$ is substantially the same all over the shaft under the condition the modulus $E_z$ is equal at any portion of the shaft. The golf club shaft thus formed is not expected to provide a good head action and not cared for by golfers in view of its feeling at impact or swinging.

Furthermore, since the shaft is formed tapering to its tip end, the tip end portion is subjected to an extremely large bending stress and liable to be broken when the golfers knock inadvertently against the ground, trees or stones with the shaft. In preparation against such troubles, the shaft may be formed according to the following proposals.

Stated illustratively, since the moduli $E_z$ and $G_{\theta z}$ and the strength $\sigma_\theta$ of the filament wound material vary with a winding angle, it is proposed to vary the winding angle along the length of the shaft to meet the purpose. The golf club shaft with the tip end portion, which is liable to undergo a large torsion, wound at a winding angle of approximately 45° and with the grip portion, where a large bending moment is exerted, wound at a winding angle of near 0°, is capable of having a sufficient resistance in torsion and enjoying a good head action of the shaft. The thus formed shaft is advantageous and satisfactory with respect to the torsion and bending of the shaft but not satisfactory with respect to the bending resistance or strength. Since the thin tip end portion to which the golf club head is attached is wound at a winding angle of around 45°, the portion is liable to be broken because of its small bending strength.

According to the present invention, the problem as mentioned above is solved as follows.

First a layer having filaments wound at a winding angle of 10° less with reference to the longitudinal axis of the shaft is provided to impart the shaft with bending stiffness and bending strength. This layer is formed of a plurality of first groups of elongated filaments wound spirally about the longitudinal axis at a winding angle of 10° or less with said axis and a plurality of second groups of elongated filaments wound spirally about the longitudinal axis at a winding angle of 10° or less with said axis in a direction opposite to said first groups. The amount of the filaments contained in said second groups is substantially equal in weight and volume to that of said first groups. The first and second groups of filaments are laid upon each other in a radial direction of the shaft. As clear from FIGS. 1 and 2, the modulus of the longitudinal elasticity and the bending strength of the filament wound material change abruptly around the winding angle of 10° and the modulus and the bending strength are not sufficient at a winding angle of more than 10°.

On the other hand, it is apparent from the shearing modulus at a winding angle of 10° or less as shown in FIG. 1 that the layer having the filaments wound at a winding angle of 10° or less does not impart the shaft with sufficient torsional rigidity. In this connection, a filament wound laminate formed of layers with different winding angles as set forth before is recommended to improve the torsional rigidity. As shown in FIG. 1, the torsional rigidity is largest at a winding angle of around 45° and does not greatly vary at a winding angle between 25° and 65°. In case of a golf club shaft which is produced by winding filaments around a mandrel of a truncated cone and an increase in thickness according to winding of the filaments is not negligible as compared with its radius, it is considerably difficult to keep the winding angle precisely at 45°. The shearing modulus, however, does not vary greatly at a winding angle of 25° to 65°. either as seen from the theoretical curve and the experimental data of FIG. 1 though it steeply decreases out of the above-mentioned angle range. In this context, it can be concluded that the layer provided for reinforcement against the torsion provides sufficient effects so far as the winding angle ranges from 25° to 65°. This layer is formed of a plurality of third groups of elongated filaments wound spirally about the longitudinal axis at a winding angle of 25° to 65° with said axis and a plurality of fourth groups of elongated filaments wound spirally about said axis at a winding angle of 25° to 65° with the axis in a direction opposite to said third groups. The amount of the filaments contained in said fourth groups is substantially equal in weight and volume to that of said third groups. These groups of filaments are laid upon each other in a radial direction of the shaft like the first and second groups of filaments. Thus, the first, second, third and fourth groups of filaments are laid upon one another in a radial direction of the shaft. The ratio in thickness of the layer with a winding angle of 10° or less to the layer with a winding angle of 25° to 65°, or the ratio of amounts of filaments contained in the two layers, is not critical and may be determined according to a golfer's preference within a range of 1:9 to 9:1 where the laminate with different widning angles can well provide its advantageous effects.

The golf club shaft formed on the laminate including the layer with a winding angle of 10° or less and the layer with a winding angle of 25° to 65° is capable of enjoying an excellent performance unexpected from a golf club shaft made according to conventional filament winding. The golf club shaft made by the conventional filament winding is formed of layers with single widning angle and can not provide a performance superior to the present golf club shaft.

Generally, the golf club shaft produced by filament winding is somehow inferior in its appearance or dimensional accuracy and accordingly, it is desirable to grind its periphery by a centerless grinder ect. In this connection, it is to be noted that when a roving of filaments is wound around the mandrel of a truncated cone according to the filament winding method, the portion of the shaft having a recuded diameter is apt to be wound thicker than the portion thereof having an increased diameter. Stated illustratively, the thickness of the material wound by filament around the mandrel of the truncated cone according to the filament winding method is obtained by a formula $$t = \frac{t_R \cdot W \cdot n}{\pi D} \qquad (11)$$

where $t_R$ is a thickness of one roving, $D$ is a diameter of the shaft, $W$ is a width of the wound roving in a circumferential direction, $n$ is twice the number of reciprocations of the roving on the shaft, and $t$ is a thickness of a layer formed by wound roving.

Since there is a relation $$W = W_R / \cos \theta°$$

where $W_R$ is a width of one roving and $\theta$ is a winding angle of the roving, the formula (11) becomes $$t = \frac{t_R \cdot W_R \cdot n}{\pi D \cos \theta°} \qquad (12).$$

Thus, as is known from the equation (12), the thickness t is in inverse proportion to the diameter of the shaft so that the thickness at the portion of reduced diameter becomes larger than the thickness at the portion of increased diameter. Accordingly, when there are provided in the shaft the inner layer which is formed immediately around the mandrel with a winding angle of 25° to 65° and the outer layer which is formed around said inner layer with a winding angle of 10° or less and the shaft is subjected to grinding so as to have a predetermined thickness and configuration, the rate of the layer with a winding angle of 25° to 65° at the portion of reduced diameter becomes larger than the rate at the portion of increased diameter. In other words, the rate of the layer with a winding angle of 25° to 65° increases according to the decrease in diameter of the shaft. This is advantageous to provide a golf club shaft reinforced with respect to a torsional resistance at its portion of reduced diameter, where the shaft is easily subjected to a torsion, by the relatively increased rate of the layer with a winding angle of 25 ° to 65° having a high torsional rigidity. By grinding of the periphery of the outer layer with the winding angle of 10° or less, the golf club shaft is given a good appearance without spoiling its torsional rigidity.

Though the laminate having the layer with the winding angle of 10° or less and the layer with the winding angle of 25° to 65° can meet the requirements in respect with the bending rigidity, the bending strength and the torsional rigidity, it will not suffice to provide an ideal golf club shaft.

As shown in FIG. 3, the moment of inertia of the cross section Ix or Iy at the portion of increased diameter are much larger than those at the portion of reduced diameter, so that said portion of increased diameter is not subjected to a large torsion even if the material of the portion has a small shearing modulus. On the other hand, when the golf club shaft is bent, the moment is largest at the portion of increased diameter and the bending characteristics are much affected by the modulus of axial elasticity.

Accordingly, the golf club shaft may be imparted with an improved bending rigidity without deterioration of the torsional characteristics by changing the winding angle of its inner layer so as to decrease according to the increase of the diameter of the shaft. Otherwise, the shaft may be made thinner and lighter by an amount corresponding to the increase in the bending rigidity. Further, the thus formed golf club shaft has a bending rigidity reduced at the tip end portion and a bending rigidity increased at the grip portion so that it can afford a so-called good head action.

Generally, there are two methods for winding a filament roving around a truncated cone mandrel. According to one filament winding, the starting point of the filament roving to be wound is arranged adjacently to the starting point of the preceding filament roving already wound and according to another filament winding, the starting point of the filament roving to be wound is not arranged adjacently to the starting point of the preceding filament roving. In the former method, the intersections of the filament rovings are disposed annularly along the circumference of the shaft at certain lateral intervals, forming a herringbone pattern. Therefore, the roving is orientated three-dimensionally at the intersections where the bending strength is much reduced and the roving or the material is liable to be broken at the portions. For the golf club shaft which is required to have a sufficient bending strength, it is recommendable to wind the roving according to the latter method.

The shape or configuration of the golf club shaft, especially diameters of the tip end portion and the grip portion are generally determined considering the feeling at the swinging of the shaft or based upon study of the grip according to human engineering. In the thus determined configuration, it is further effective to vary the thickness of the shaft to improve the bending rigidity, the bending strength and the torsional rigidity and to reduce the weight of the shaft as much as possible. Since the portion of the shaft having reduced diameter is liable to be broken and subjected to a torsion, the tip end portion of the shaft may be made larger in thickness than the grip portion to provide a golf club shaft of better performance. For this purpose, the thickness of the inner layer with a winding angle of 25° to 65° may be varied so as to be larger at the tip end portion than at the grip portion and the thickness of the outer layer may be made uniform all over the shaft length to provide a golf club shaft of small torsion and large bending strength and bending rigidity.

According to the present invention as mentioned above, the bending rigidity may be easily controlled through grinding of the outer layer to differentiate the hardness of the shaft according to necessity. In order to vary the bending rigidity of the shaft, the outer layer may be subjected to the grinding, keeping a certain thickness equally all over the shaft or varying the tapering angle of the shaft.

When the shaft is assembled into a gold club, the portion of the shaft where the club head is mounted is subjected to stress concentration at the extent of possible breakage. Therefore, the shaft may be further reinforced against such stress concentration by steeply reducing the inner diameter of the shaft so as to increase the thickness of the shaft at the portion.

In the following, the method for producing the shaft with the winding angle varying along the length of the shaft will be explained.

Ordinary filament winding machines can not vary winding angles along the length of the shaft. In such a machine, the ratio of a moving speed of a roving guide to rotational frequency of a mandrel is fixed along the length of the mandrel. Accordingly, in case a columnar mandrel is used, the winding angle is kept constant along the length of the mandrel, while in case a mandrel having a diameter varying in the axial direction, for example a mandrel of truncated cone is employed, the winding angle varies along the length of the mandrel. Such a varying in the winding angle will greatly affect the dynamic properties, so that the ratio of the moving speed of the roving guide to the rotational frequency of the mandrel is required to be varied according to the position of the roving guide to obtain a filament wound material of a truncated cone having uniform properties along its length. According to the present invention, there is employed a filament winding machine which is capable of differing the ratio of the moving speed of the roving guide to the rotational frequency of the mandrel along the length of the mandrel by relatively keeping the position of a belt of a cone-drum transmission in a parallel relation with the position of the roving guide.

Referring now to FIGS. 4 to 14, where is illustrated a golf club shaft and a method for producing the same according to the present invention.

Figure 4:
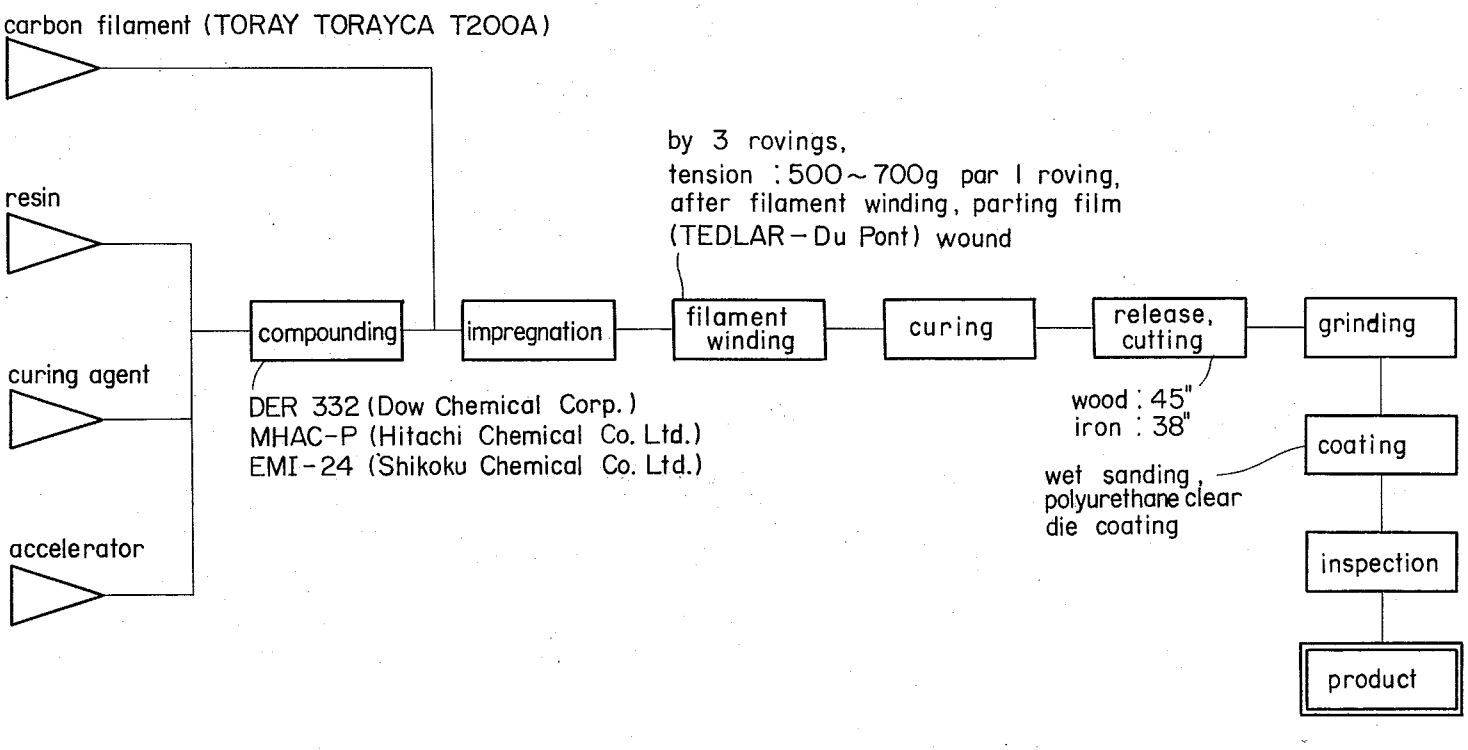
FIG. 4 is a block diagram showing the production process of the golf club shaft according to the present invention.

FIG. 4 illustrates a production process of the present invention, wherein carbon filament for example, TORAYCA T-200A (trade mark of carbon filament sold by Toray Industry, Inc.), matrix resin such as epoxy resin of bisphenol type, for example, DER 332 (trade mark of bisphenol type epoxy resin sold by Dow Chemical Corp.), a curing agent such as methyl-himic anhydride (methyl-3,6-endo-methylene-tetrahydrophthalic anhydride), for example, MHAC-P (trade mark of methyl-himic anhydride sold by Hitachi Chiemical Co., Ltd.) and an accelerator such as 2-ethyl-4-methyl imidazole, for example EMI-24 (trade mark of 2-ethyl-4-methyl imidazole sold by Shikoku Chemical Co., Ltd.) are employed. These resinous materials are compounded and heated to 35° C to 50° C for reducing the viscosity. Three rovings are grouped to form a unit of filament winding and made pass through a bath of the compounded resinous materials to be impregnated with such resinous materials. The grouped rovings thus impregnated with the resinous materials are wound by a filament winding machine as shown in FIG. 5, undergoing a tension of 300 to 700 g per one roving.

Figure 5:
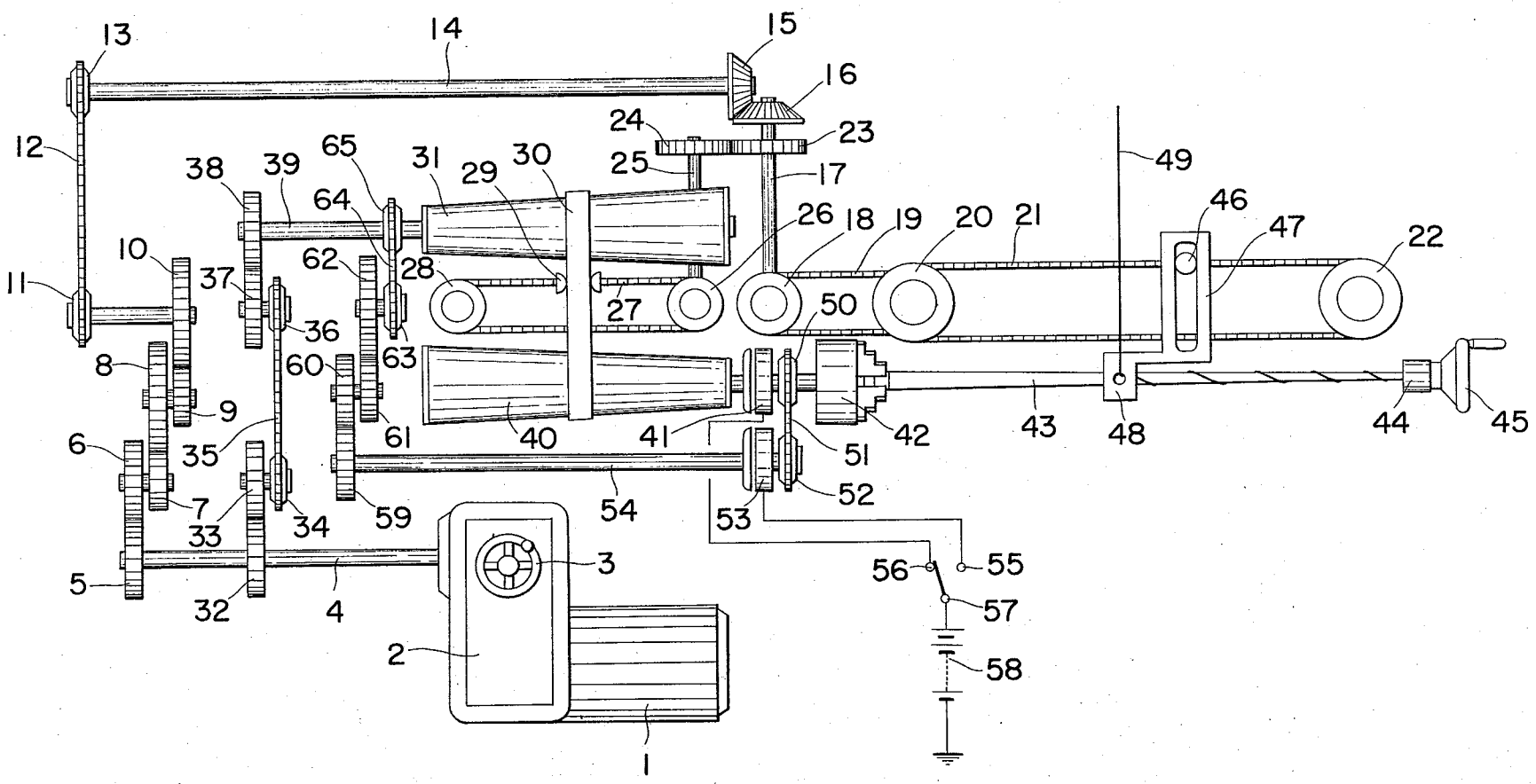
FIG. 5 is a gear block diagram of the filament winding machine according to the present invention.

In FIG. 5, the rotational frequency of a motor 1 is changed through a speed change device 2. A handle 3 is operated to change a transmission ratio according to an operating condition. The rotation of an output shaft 4 is transmitted to two different systems. One of them is for driving a roving guide 48 and the other is for rotating an mandrel 43. The winding angle and the pitch of the filament winding are determined by a relative movement of the roving guide 48 and the mandrel 43. Gears 5, 6, 7, 8, 9 and 10 for driving the roving guide 47 are adapted to determine the winding angle and the pitch desired. Shafts of the respective gears 6, 7, 8, 9 and 10 are variable and movable when the gears are required to be exchanged. A sprocket 18 is rotated through a sprocket 11, a chain 12, a sprocket 13, a shaft 14, a miter gears 15 and 16 and a shaft 17. According to the rotation of the sprocket 18, a sprocket 20 having two wheels of different diameters is rotated through a chain 19. Across one of the wheels of the sprocket 20 other than the wheel on which the chain 19 is carried and a sprocket 22, a chain 21 for driving a carriage 47 is mounted. The rotation of the miter gear 16 further rotates a shaft 25 and a sprocket 26 through gears 23 and 24. Across the sprocket 26 and a sprocket 28 is suspended a chain 27 for driving a speed change belt guide 29. The chain 27 and the chain 21 for driving the carriage 47 moves in parallel with each other. More particularly, a pin 46 connected to the chain 21 and a speed change belt 30 connected to the chain 27 move keeping a parallel relation with each other. When the pin 46 is positioned on the right side of the sprocket 22, a speed change belt guide 29 is located on the right side of the sprocket 26 and when the pin 46 is on the left side of the sprocket 20, the guide 29 is also located on the left side of the sprocket 28.

The belt 30 adapted to be moved by the belt guide 29 is mounted across a driving cone 31 and an output cone 40. The driving cone 31 is connected to a shaft 39 which is connected to and rotated by the output shaft 4 through gears 32, 33, 37 and 38 for driving the mandrel, sprockets 34 and 36 and a chain 35. The gears 32, 33, 37 and 38 may be exchanged so as to change a gear ratio according to required rotational frequency and torque of the mandrel.

The output cone 40 is connected to a chunk 42 through an electromagnetic clutch 41. The mandrel 43 is held at its one end by the chuck 42 and supported at its other end by a center 44. The center 44 is movable by a handle 45.

The pin 46 is engaged with the carriage 47 and the carriage 47 is reciprocated by said pin 46. The roving guide 48 is provided on the carriage 47 and adapted to guide the roving 49 which is impregnated with resinous materials.

The filament winding machine of the present invention thus constructed is capable of changing a winding angle along the length of the filament wound material because the rotational frequency of the mandrel 43 is changed according to the position of the roving guide 48.

Thus, according to the present invention, the rovings impregnated with thermo-hardening resinous materials are wound around the mandrel 43 at a winding angle varying between 25° and 65°, more preferably at a winding angle varying so as to be about 45° at a tip end portion of the shaft and about 30° at a grip portion to form an inner layer of the shaft.

After completion of forming of the inner layer, the electromagnetic clutch 41 is released and another electromagnetic clutch 53 is connected. The switching of the clutch 41 to the clutch 53 is effected by switching of contacts 55, 56 and 57. The contact 57 is connected to a power souce of DC 24V and grounded by a frame of the machine where the clutches 41 and 53 are also grounded. Upon release of the clutch 41 and connection of the clutch 53, the mandrel 43 rotates a shaft 53 through sprockets 50 and 52 and a chain 51. The rotation of the shaft 54 is transmitted to a shaft 39 through gears 59, 60, 61 and 62, a sprocket 63, a chain 64 and a sprocket 65. The rotation of the shaft 39 is reduced through gears 59, 60, 61 and 62 so that the rovings are wound around the mandrel 43 at a winding angle of 7° at a portion having a diameter of 10mm to form an outer layer.

Figure 6:
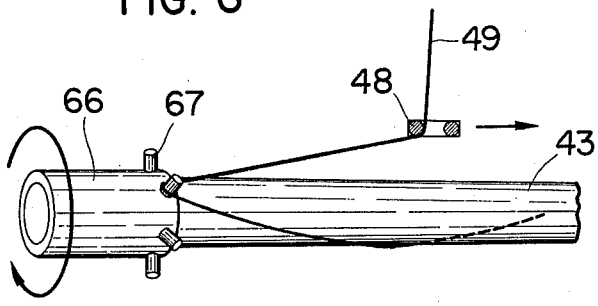
FIG. 6 is an explanatory view of a device for winding the filaments at a small angle with the axis of the shaft.

In case of a filament winding at a winding angle so small as 7° or so, the rovings can not be wound slipping on the mandrel 43 after its turning at the ends of the mandrel, to solve this problem, a device as shown in FIG. 6 is proposed. In FIG. 6, a cylinder 66 is fixed to each of the ends of the mandrel 43 and adapted to rotate conjointly therewith. On the periphery of the cylinder 66 are provided a plurality of pins 67 which are adapted to catch the rovings 49 when the roving guide 48 comes to the ends of the mandrel to prevent the rovings from slipping.

Figure 7:
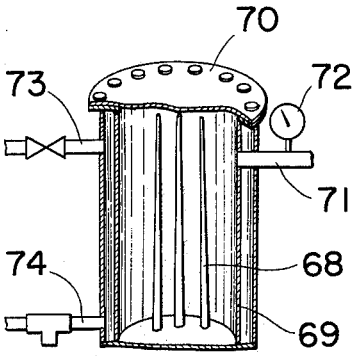
FIG. 7 is an explanatory view of a pressure tank with a steam jacket employed in the present invention.

Thus, the unhardened shaft having the inner and the outer layer is formed by winding the rovings impregnated with the resinous materials around the mandrel. Prior to hardening, the shaft is covered by parting film such as vinyl fluoride film having a width of 20mm, for example, TEDLAR (trade mark of parting film sold by Du Pont Chemical Corp.) wound around the shaft to prevent dropping of the resinous materials. The thus covered shaft is heated to be hardened. Stated illustratively, the unhardened shaft 68 formed around the mandrel is hung in a pressure tank 69 with a steam jacket and then the tank 69 is closed by a pressure lid 70 as shown in FIG. 7. Air is taken into the tank 69 by an air pipe 71 to increase the pressure in the tank 69 up to 10 kg/cm$^2$. A meter 72 is provided to read the inside pressure. To heat the inside of the tank 69, steam is sent to the tank 69 through a pipe 73 which communicates with the jacket and liquefied water is discharged through a drain pipe 74. The shaft is heated for two hours at a temperature of 120° C and for two hours at a temperature of 150° C to make the shaft hardened without heat residual stress. At this process, care should be taken lest the shaft should be hung improperly along its course or subjected to abrupt heating to avoid possible bending of the shaft.

Figure 8:
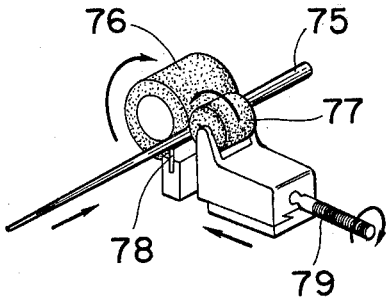
FIG. 8 is an explanatory view showing the grinding by a centerless grinder according to the present invention.

After completion of the hardening, the mandrel is released and the parting film is removed off the shaft which is then cut into a predetermined length (45 inches for "wood"; about 38 inches for "iron"). The shaft is subsequently subjected to a grinding by a centerless grinder as shown in FIG. 8 to have predetermined dimensions and bending rigidity. FIG. 8 illustrates the grinding process by the centerless grinder, wherein the shaft 75 released from the mondrel and cut into the predetermined length is ground by a grinding wheel 76 and fed by a feeding grinder 77. A knife 78 is disposed in a position abuttable against the shaft 75 between the two grinders. The distance between the grinders 77 and 76 is adjustable by a screw 79 so as to grind the surface of the shaft 75 into a desired tapered configuration.

Figure 9:
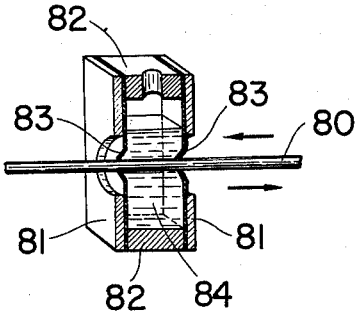
FIG. 9 is an explanatory view showing the die coating according to the present invention.

The thus ground shaft 80 is subjected to a wet grinding and then subjected to a die coating with polyurethane surface coating material as shown in FIG. 9. In FIG. 9, semi-translucent rubber material 83 with an opening smaller than the tip end portion of the shaft is disposed between side plates 81 and a frame 82 in which the polyurethane coating material 84 is contained. While the shaft 80 is squeesing through said opening of the rubber material 83, the shaft 80 is coated with the polyurethane coating material 84 uniformly. The coating of the shaft is then dried and the shaft is inspected to guarantee the quality of the product.

Though in the present invention, only TORAYCA T-200A is used for filaments to be wound, different kinds of filaments having different weights and volumes may be employed so far as the total amounts of the filaments contained in the respective groups wound at same winding angle and in an opposite direction are substantially equal to each other in weight and volume.

Figure 10:
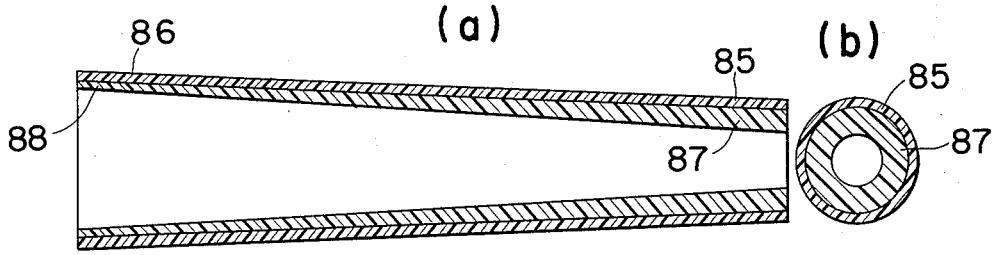

FIG. 10 shows the golf club shaft according to the present invention. The golf club shaft generally has dimensions of 6 to 9mm in diameter of the tip end portion, 14 to 17mm in diameter of the grip portion and 45 inches in length of wood and 38 inches in length of iron. The golf club shaft as shown in FIG. 10 is a shaft of wood and has smallest diameter of 7.8mm at its tip end and largest diameter of 16mm at its other end and length of 45 inches. The outer layer of said shaft is wound at a winding angle varying from 4° at a portion 85° to 8° at a portion 86 because the mandrel is formed in a tapered configuration and the filaments are wound therearound by an ordinary filament winding machine without using the cone drums as mentioned above. In the ordinary winding machine, the ratio of the rotational frequency of the mandrel to the delivery speed is fixed as mentioned above. However, the variation in the winding angle of the outer layer ranging from 4° to 8° is negligible in relation with the dynamic characteristics and accordingly, the outer layer may be formed by such a simple method as by the ordinary filament winding machine. While, the inner layer is wound at a winding angle varying from 45° at a portion 87° to 30° at a portion 88. In this connection, it is to be noted that the radio of the rotational frequency of the mandrel to the delivery speed is required to be varied according to portions of the mandrel to wind the filaments with a winding angle grandulally varying from 30° at the largest diameter portion to 45° at the smallest diameter portion as mentioned above. In other words, in case the delivery speed is fixed, the rotational frequency of the mandrel is adjusted so as to be higher at a reduced diameter portion and lower at an increased diameter portion. According to this winding, the thickness of the inner layer of the shaft is made largest at the smallest diameter portion and smallest at the largest diameter portion.

As shown in FIG. 10, the thickness of the outer layer 85 and 86 is uniform in its longitudinal direction and the thickness of the inner layer 87 and 88 is made larger at its reduced diameter portion and smaller at its increased diameter portion so that the total thickness of the shaft is made largest at its tip end and smallest at its other end. The thickness of the shaft as shown in FIG. 10 is about 2mm at its tip end and about 1mm at its other end. The ratio of the thickness of the inner layer and the thickness of the outer layer of the shaft is 2.5 at its tip end and 1.0 at its other end.

Figure 11:
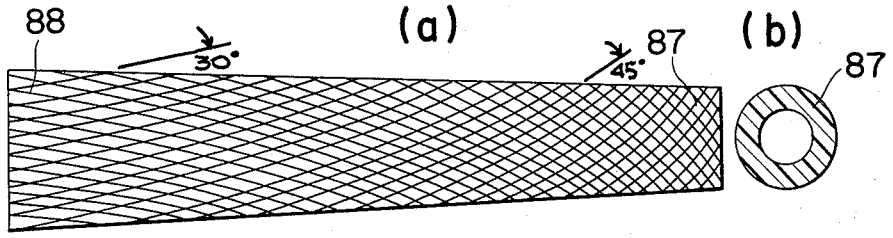

FIG. 11 is a side elevational view of the inner layer 87 and 88 of the shaft as shown in FIG. 10. As seen from FIG. 11, the winding angle is gradually varying from 45° at its tip end to 30° at is its other end.

Figure 12:
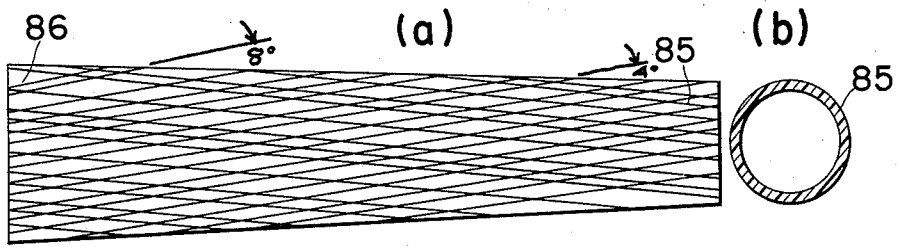

FIG. 12 is a side elevational view of the layer of relatively wide winding angle, viz. outer layer 85 and 86 of the shaft as shown in FIG. 10. In forming the outer layer, the filaments are wound so that the starting point of one groups of filament rovings may not be arranged adjacently to a preceding group of filament rovings already wound. Thus, since the carbon filament rovings are not arranged regularly but disposed rather at random as shown in FIG. 12, nodes of the rovings are not formed annularly along the circumference of the shaft, whereby the bending rigidity is improved as mentioned before. In order to wind filament rovings at random as shown in FIG. 12, the pitch or spacing between a preceding group of the filament rovings and a suceeding group of the filament rovings should be larger than the width of one group of the filaments and the circumference of the shaft may not be an integral multiple of said pitch.

FIG. 13 shows the golf club shaft according to the present invention in relation with golf head 90. The shaft is subjected, at its portion where the golf club head is mounted, to wit, its portion distanced by 100mm from the tip end in wood and its portion distanced by about 40mm from the end in iron, to a maximum impact load when a golfer duffs a golf ball.

FIG. 14 shows another form of the golf club shaft in which the inner diameter thereof is reduced by 1mm at the portion 89 where the club head is mounted thereby to increase the thickness of the outer layer, which has a high breaking resistance, at the portion by 0.5mm for reinforcement against possible breakage.

Though the golf club shafts as mentioned above are so formed that its diameter reduces from one end to its other end, the shafts may alternatively be formed of longitudinally successive hollow truncated cones.

The golf club shaft according to the present invention has remarkable advantages over golf club shafts produced according to conventional methods. Stated illustratively, a golf club shaft by conventional filament winding is comparatively good in torsional characteristics but extremely weak in bending strength (breaking load; about 40 to 55 kg) which, in fact, sometimes causes breakage in playing. On the other hand, a golf club shaft produced according to prepreg sheet winding is imparted with a rather strong bending strength but easily subjected to a torsion (about twice the torsion of the present invention). In contrast, the golf club shaft according to the present invention has a considerable resistance against a torsion, a sufficient resistance against breakage (breaking load: about 70 to 80 kg) at its tip end portion and is capable of being made lighter by about 20g than the conventional golf club shaft made of filament or fiber reinforced resins.

Though in the forgoing embodiment, a golf club shaft produced by a filament winding is illustratively shown, the present invention should not be limited thereto. A golf club shaft employing prepreg sheet wound therearound so that the filaments are arranged at different angles as specified in the present invention can also afford such remarkable effects of the present invention.

What is claimed is:

1. A hollow golf club shaft with its diameter reducing from one end to the other end and consisting essentially of (a) a plurality of first groups of elongated filaments wound spirally about the longitudinal axis of the shaft at a winding angle of 10° or less with said axis, (b) a plurality of second groups of elongated filaments wound spirally about the axis at winding angle of 10° or less with said axis in a direction opposite to said first groups, the amount of the filaments contained in said plurality of second groups being substantially equal in weight and volume to that of the first groups, (c) a plurality of third groups of elongated filaments wound about the axis at a winding angle of about 25° to 65° with said axis, (d) a plurality of fourth groups of elongated filaments wound spirally about the axis at a winding angle of about 25° to 65° with said axis in a direction opposite to said third groups, the amount of the filaments contained in said plurality of fourth groups being substantially equal in weight and volume to that of the third groups, the first, second, third and fourth groups of filaments being laid upon one another, the winding angles of the third and fourth groups of the filaments being larger at a portion of the shaft having a reduced diameter than at a portion of the shaft having an increased diameter and continuously varying inversely with the shaft diameter, and (e) a heat-hardened synthetic resinous material binding the filaments and filling the interstices therebetween to form a unitary solid mass.

2. A golf club shaft according to claim 1, wherein the third and fourth groups of filaments constitute an inner layer of the shaft and the first and second groups of the filaments are wound around said inner layer and constitute an outer layer of the shaft.

3. A golf club shaft according to claim 2, wherein the ratio of the thickness of the inner layer to that of the outer layer varies inversely with the diameter of the shaft.

4. A golf club shaft according to claim 2, wherein said first and second groups of the filaments have their intersections disposed randomly all over the length and circumference of the shaft.

* * * * *